US006868576B2

(12) United States Patent
Petner

(10) Patent No.: US 6,868,576 B2
(45) Date of Patent: Mar. 22, 2005

(54) ROLLER MOP CONNECTION SYSTEM

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 152 days.

(21) Appl. No.: 10/408,823

(22) Filed: Apr. 4, 2003

(65) Prior Publication Data

US 2004/0194243 A1 Oct. 7, 2004

(51) Int. Cl.[7] ..... A47L 13/144
(52) U.S. Cl. ..... 15/119.2
(58) Field of Search ..... 15/119.1, 119.2, 15/116.1, 116.2

(56) References Cited

U.S. PATENT DOCUMENTS

| | | | | |
|---|---|---|---|---|
| 3,226,752 A | * | 1/1966 | Antonucci, Jr. | 15/119.2 |
| 3,345,667 A | * | 10/1967 | Blum | 15/119.2 |
| 3,727,259 A | | 4/1973 | Wilson | |
| 4,481,688 A | | 11/1984 | Graham | |
| 4,706,323 A | * | 11/1987 | Batchelor | 15/119.2 |
| 4,862,550 A | | 9/1989 | Batchelor | |
| 5,331,706 A | | 7/1994 | Graham | |

* cited by examiner

*Primary Examiner*—Gary K. Graham
(74) *Attorney, Agent, or Firm*—Stuart M. Goldstein

(57) ABSTRACT

A connection system for a roller mop has an operating rod to control the positioning of a deformable cleaning member between spaced apart rollers. At the end of the operating rod is a lateral extension with a raised medial section. The extension is inserted into dual receptacles on the supporting plate of the cleaning member, with the raised section positioned between the receptacles. The dimensions of the receptacles are such that they are wider than they are high. They are so sized to slidably receive the extension and its raised section, when the cleaning member is inserted onto the extension, such that the raised section fits the width of the receptacles. However, when the cleaning member is rotated 90°, thus positioning the cleaning member for cleaning operations, the raised section of the extension is also rotated, and now is located between the receptacles. The raised section, having a height greater than the height of the receptacles, acts as a stop, ensuing that there is no movement between the operating rod and the cleaning member. A rigid joint is thus formed between the handle and cleaning member of the mop. A threaded connection between the extension and the plate of the cleaning member provides a secondary means of securing the operating rod, and hence the rest of the mop, to the cleaning member.

10 Claims, 4 Drawing Sheets

ROLLER MOP CONNECTION SYSTEM

BACKGROUND OF THE INVENTION

This invention relates generally to roller type mops in which spaced apart roller members are connected to a handle via a frame and a deformable cleaning member is drawn through the rollers to squeeze dirt and water out of the cleaning member. Such roller mops or roller sponge mops are well known and have achieved a wide level of consumer acceptance. However, these types of mops periodically require that their cleaning members be replaced. This can be a difficult job, since the connection between the cleaning member and the operating mechanism of the mop, by necessity of operation, is tight and often difficult to loosen after a build-up of dirt after prolonged use. The old cleaning member itself is usually caked with dirt and grime, which makes the job even more unpleasant.

There have been numerous prior attempts to provide a roller mop to cleaning member connection which addresses these problems. Such attempts are illustrated by U.S. Pat. Nos. 3,727,259; 4,481,688; 4,862,550; and 5,331,706. However, in each of these connection systems and others in the prior art, the cleaning member, being securely positioned, must be jiggered, twisted, manipulated or otherwise forceably removed from its respective operating rod by the user. This presents the user with the obvious problem of having to struggle to remove the tightly fitted cleaning member which, because of the filth, dirt and grime build-up, may further be jammed on the operating rod. When the old component is finally removed, the user faces the prospect of having to forceably reinsert a new cleaning member.

Therefore, while roller sponge mops have achieved relatively wide commercial acceptance, there are aspects to the operation of these mops which require improvement of the roller mop as an efficient cleaning tool.

SUMMARY OF THE INVENTION

It is thus an object of the present invention to overcome the limitations and disadvantages of prior roller sponge mops and mop attachments.

It is an object of the present invention to provide a roller mop connection system which allows the cleaning member of the roller mop to be rigidly and immovably positioned when the mop is in the cleaning mode.

It is a further object of the present invention to provide a roller mop connection system which allows the cleaning member of the roller mop to be cleanly and easily removed from the mop, without the use of excessive force or difficulty in removal.

It is still another object of the present invention to provide a roller mop connection system which allows clean and easy replacement of the cleaning member of the roller mop with another cleaning member.

It is another object of the present invention to provide a roller mop connection system which uses a rotatable mop attachment system to accomplish the clean, efficient and easy removal and replacement of the cleaning member of the roller mop.

These and other objects of the invention are accomplished by the subject roller mop connection system which comprises an operating rod to control the positioning of a deformable cleaning member between spaced apart rollers. At the end of the operating rod is a lateral extension with a raised medial section. The extension is inserted into dual receptacles on the supporting plate of the cleaning member, with the raised section positioned between the receptacles. The dimensions of the receptacles are such that they are wider than they are high. They are so sized to slidably receive the extension and its raised section, when the cleaning member is inserted onto the extension, such that the raised section fits the width of the receptacles. However, when the cleaning member is rotated 90°, thus positioning the cleaning member for cleaning operations, the raised section of the extension is also rotated, and now is located between the receptacles. The raised section, having a height greater than the height of the receptacles, acts as a stop, ensuing that there is no movement between the operating rod and the cleaning member. A rigid joint is thus formed between the handle and cleaning member of the mop. A threaded connection between the extension and the plate of the cleaning member provides a secondary means of securing the operating rod, and hence the rest of the mop, to the cleaning member.

Novel features which are considered as characteristic of the invention are set forth in particular in the appended claims. The invention itself, however, both as to its design, construction and use, together with the additional features and advantages thereof, are best understood upon review of the following detailed description with reference to the accompanying drawings.

DETAILED DESCRIPTION OF THE INVENTION

Figure 1:
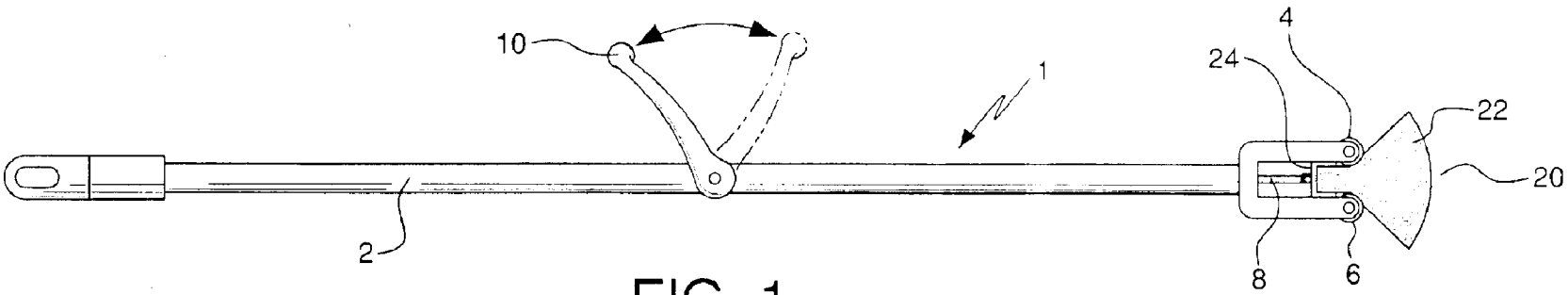
FIG. 1 is a side view of a typical roller mop employing the present invention in its cleaning mode.
Figure 2:
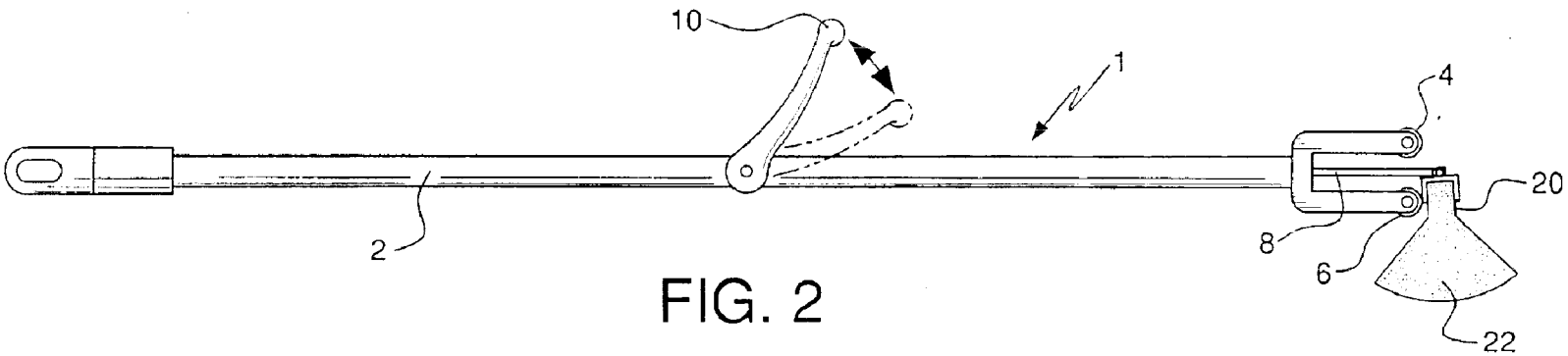
FIG. 2 is a side view of a typical roller mop employing the present invention in its cleaning member removal mode.
Figure 3:
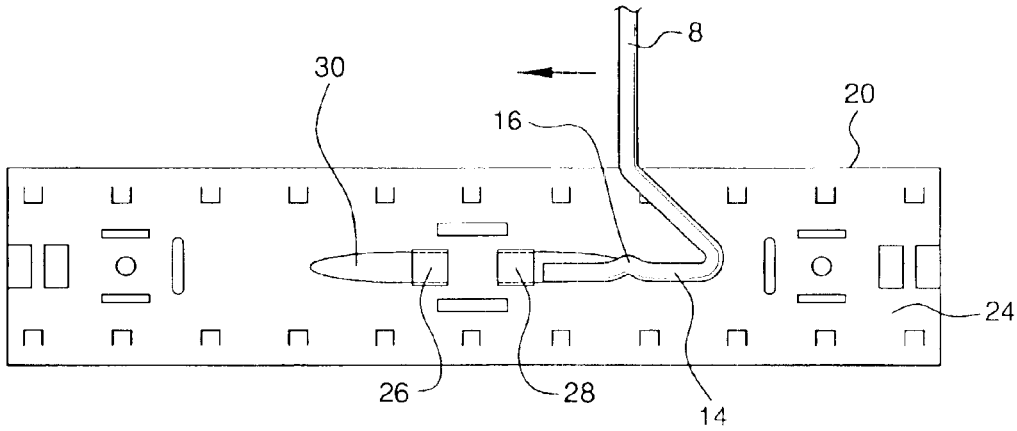
FIG. 3 is a top view of the cleaning member of the present invention prior to connection with the operating rod of the invention.
Figure 4:
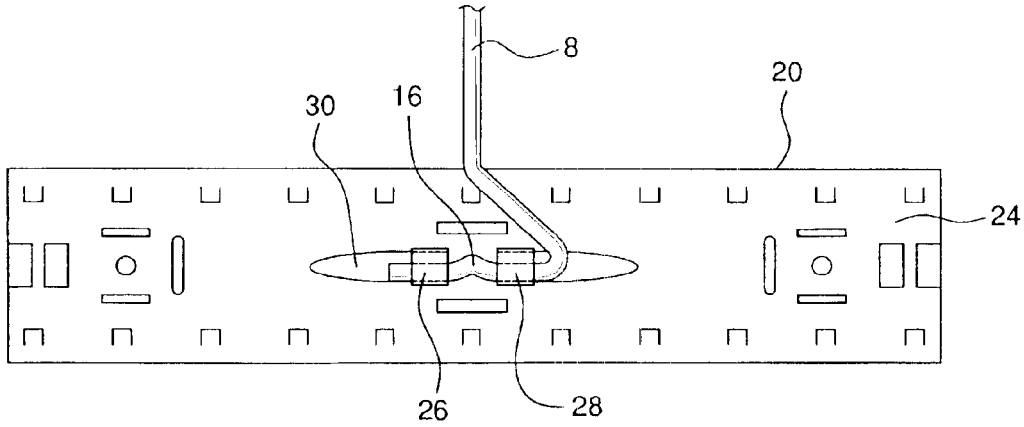
FIG. 4 is a top view of the connection between the cleaning member and operating rod of the present invention.
Figure 5:
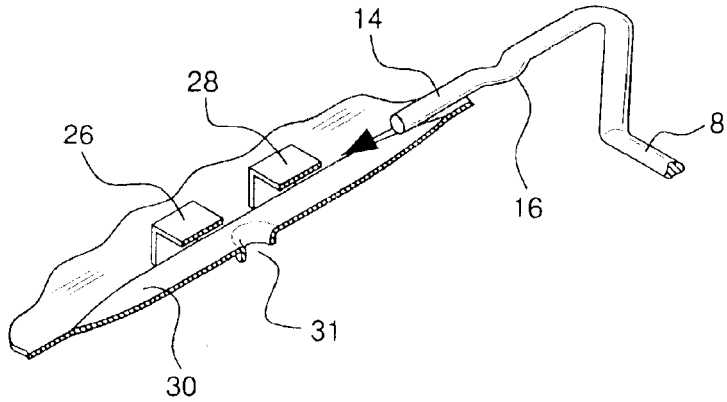
FIG. 5 depicts the initial step in the connection between the cleaning member and the operating rod of the present invention.
Figure 6:
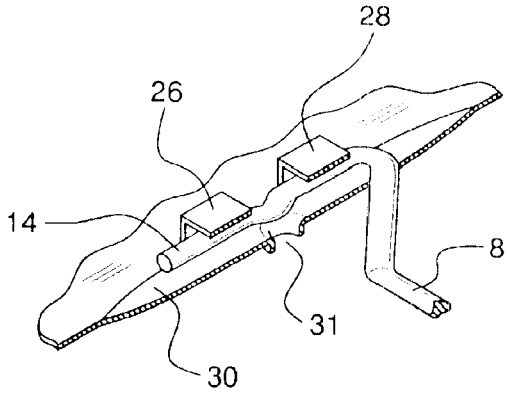
FIG. 6 depicts the connection step which follows that which is shown in FIG. 5.

Roller mop 1 comprises longitudinally elongated handle 2 and spaced apart rollers 4 and 6. Operating rod 8, positioned in spaced relation to handle 2, is controlled and activated by lever 10, which provides for movement of the rod parallel to the handle, as is well-known in the art, as is seen in FIGS. 1 and 2. At its furthest end, operating rod 8 comprises angled lateral extension 14. Raised section 16 is located substantially medially on extension 14.

Roller mop 1 further comprises cleaning member 20, comprising a deformable, e.g. sponge, section 22, and support plate 24. Dual tunnel-like receptacles 26 and 28 extend upwardly from recessed surface 30, located substantially at the center of plate 24. Receptacles 26 and 28 each have a width which is greater than their respective heights.

Raised section 16 of extension 14 of rod 8 is configured to be positioned between receptacles 26 and 28. The dimensions of receptacles 26 and 28 are such that, when extension 14 is located with the receptacles and rod 8 is perpendicular to plate 24 of cleaning member 20, raised section 16 is immovably positioned between the receptacles. However, given the larger widths of receptacles 26 and 28, raised section 16 of extension 14 is sized to be slidably removed from the receptacles when rod 8 is positioned substantially parallel to plate 24 of cleaning member 20.

Figure 7:
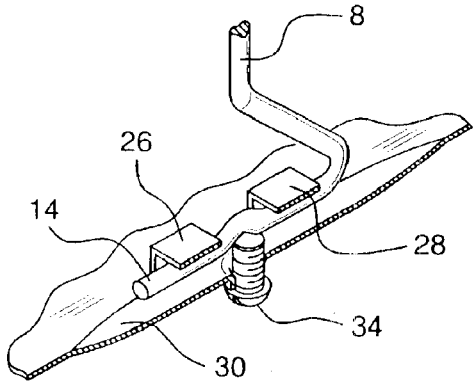
FIG. 7 depicts the connection step which follows that which is shown in FIG. 6, and the cleaning member and operating rod fully connected.
Figure 8:
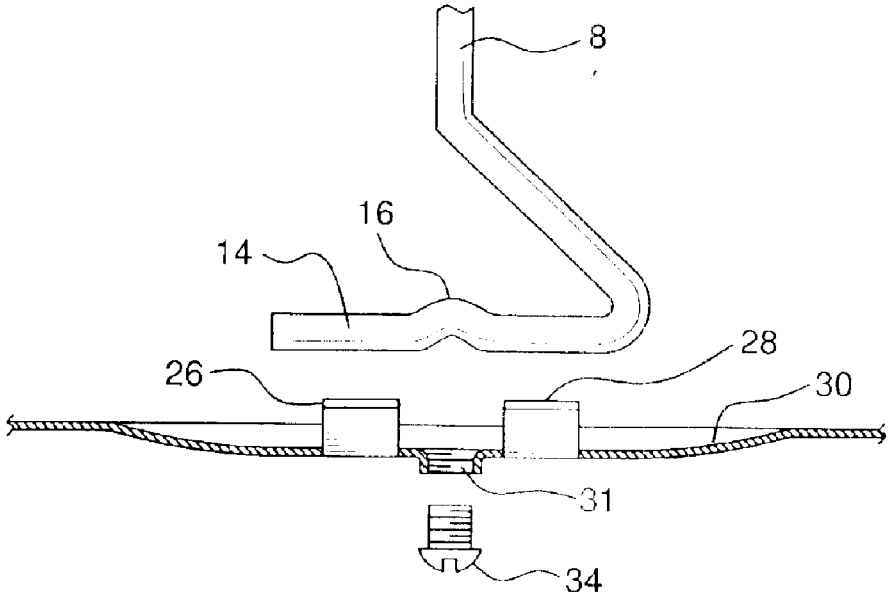
FIG. 8 is a partial side view showing the relationship between components of the present invention prior to their connection.
Figure 9:
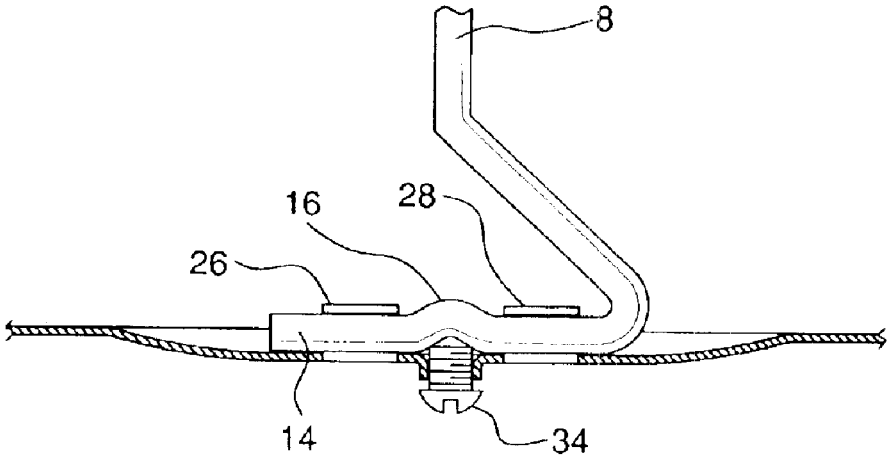
FIG. 9 is a partial side view showing the relationship between components of the present invention following their connection.

When mop 1 is configured in its cleaning mode position, i.e. with lever 10 pulled towards the user as seen in FIG. 1, operating rod 8 fully extended up the handle, and cleaning member 20 is positioned between and adjacent to rollers 4 and 6. In this position, also as seen in FIG. 7, rod 8 is substantially perpendicular in relation to plate 24 of cleaning member 20. Extension 14 of rod 8 is located within receptacles 26 and 28. In this cleaning mode position, raised section 16 provides a stop between receptacles 26 and 28, which results in a rigid, immovable joint between rod 8 and cleaning member 20.

After prolonged use, cleaning member 20 will need to be removed and replaced. To place mop 1 in a position to remove cleaning member 20, lever 10 is pushed towards the roller end of the mop. Continued pushing of lever 10 results in the end of rod 8 and cleaning member 20 extending past rollers 4 and 6, as shown in FIG. 2. Once past rollers 4 and 6, extension 14, positioned within receptacles 26 and 28, allows cleaning member 20 freedom to rotate substantially 180°, around extension 14 of rod 8. It can thus be appreciated that 90° of rotation of cleaning member 20 about extension 14 will also change the position of raised section 16 in relation to receptacles 26 and 28 by 90°. In this rotated, 90° position, rod 8 is located substantially parallel to plate 24, as seen in FIG. 2. From this position, the wider dimensions of the receptacles will allow slidable, easy removal of cleaning member 20 from extension 14.

A new cleaning member 20 can be replaced by sliding extension 14 into receptacles 26 and 28 of the new cleaning member, as seen in FIGS. 3–6. Rod 8 is then rotated 90° once again, into a position perpendicular to plate 24. See FIG. 7. Pulling lever 10 withdraws operating rod 8 up the handle, positioning new cleaning member 20 between rollers 4 and 6, and again placing mop 1 in its cleaning mode.

An added feature of this system provides for threaded hole 31 in plate 24 to be aligned with the bottom surface of raised section 16. An attachment device, like threaded screw 34, extends through hole 31 and is tightened against section 16; thus providing a secondary means of securing the components.

By this invention a quick, simple, and clean way of replacing the cleaning member of a roller mop and ensuring for a rigid, immovable connection between cleaning member and the rest of the mop during normal cleaning operations is accomplished.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

I claim:

1. A roller mop comprising:

(a) a longitudinally elongated handle;

(b) spaced apart rollers;

(c) a deformable cleaning member;

(d) actuating means for moving the cleaning member in relation to the rollers, for maintaining the cleaning member in a cleaning mode, and for positioning the cleaning member in a removal mode; and, (e) attachment means to removably connect the actuating means to the cleaning member, said attachment means comprising an extension of the actuating means and receptacles on the cleaning member for receiving and maintaining the extension thereon, whereby when the cleaning member is in the cleaning mode, the attachment means provides a rigid, immovable joint between the actuating means and the cleaning member, and when the cleaning member is in the removal mode, the attachment means supports the cleaning member so that it is freely rotatable approximately 180° about the actuating means.

2. The roller mop as in claim 1 wherein the actuating means comprises an operating rod.

3. The roller mop as in claim 1 wherein the extension comprises stop means for maintaining the immovable joint between the actuating means and the cleaning member in the cleaning mode, said stop means allowing the rotation of the cleaning member about the actuating means in the removal mode.

4. The roller mop as in claim 1 further comprising second attachment means to secure the actuating means to the cleaning member.

5. The roller mop as in claim 4 wherein the second attachment means comprises an opening in the actuating means, a corresponding opening in the cleaning member, and engagement means threadably insertable into the openings.

6. A roller mop comprising:

(a) a longitudinally elongated handle;

(b) spaced apart rollers;

(c) an operating rod in spaced relation to the handle, said rod comprising an extension with a substantially medially raised section; and, (d) a deformable cleaning member comprising mu1tiple receptacles for receiving the extension of the operating rod, the raised center section, at all times, being positioned between the receptacles and providing a rigid, immovable joint between the operating rod and the cleaning member when the cleaning member is in a cleaning mode, and allowing the cleaning member to rotate substantially 180° about the operating rod when the cleaning member is in a removal mode.

7. The roller mop as in claim 6 further comprising attachment means to secure the operating rod to the cleaning member.

8. The roller mop as in claim 7 wherein the attachment means comprises an opening in the extension, a corresponding opening in the cleaning member, and engagement means threadably insertable into the openings.

9. A roller mop comprising:

(a) a longitudinally elongated handle;

(b) spaced apart rollers;

(c) a deformable cleaning member.

(d) actuating means for moving the cleaning member in relation to the rollers, for maintaining the cleaning member in a cleaning mode, and for positioning the cleaning member in a removal mode;

(e) attachment means to removably connect the actuating means to the cleaning member, whereby when the cleaning member is in the cleaning mode, the attachment means provides a rigid, immovable joint between the actuating means and the cleaning member, and when the cleaning member is in the removal mode, the attachment means supports the cleaning member so that it is freely rotatable approximately 180° about the actuating means; and (f) second attachment means to secure the actuating means to the cleaning member.

10. The roller mop as in claim 9 wherein the second attachment means comprises an opening in the actuating means, a corresponding opening in the cleaning member, and engagement means threadably insertable into the openings.

* * * * *